US008079241B2

(12) United States Patent
Lin

(10) Patent No.: US 8,079,241 B2
(45) Date of Patent: Dec. 20, 2011

(54) ADJUSTABLE SHAFT FOR DOOR LOCK ASSEMBLY

(75) Inventor: Ching Tien Lin, Taipei Hsien (TW)

(73) Assignee: Thase Enterprise Co., Ltd., Sinjhuang, Taipei Hsien (TW)

( * ) Notice: Subject to any disclaimer, the term of this patent is extended or adjusted under 35 U.S.C. 154(b) by 128 days.

(21) Appl. No.: 12/661,057

(22) Filed: Mar. 10, 2010

(65) Prior Publication Data

US 2011/0219832 A1 Sep. 15, 2011

(51) Int. Cl.
*E05B 63/00* (2006.01)

(52) U.S. Cl. ..... 70/461; 70/329; 70/422; 292/358; 292/DIG. 60

(58) Field of Classification Search ..... 70/188, 70/189, 222, 223, 329, 461; 292/169.22, 292/336.5, 358, 359, DIG. 60
See application file for complete search history.

(56) References Cited

U.S. PATENT DOCUMENTS

| | | | | |
|---|---|---|---|---|
| 649,706 | A * | 5/1900 | Phelps | 292/224 |
| 1,899,996 | A * | 3/1933 | Sullivan | 70/216 |
| 2,002,542 | A * | 5/1935 | McKinney, Jr. | 70/153 |
| 2,459,920 | A * | 1/1949 | Clark | 70/223 |
| 2,497,329 | A * | 2/1950 | Smith et al. | 292/169.14 |
| 2,577,216 | A * | 12/1951 | Spinello | 292/173 |
| 5,040,652 | A * | 8/1991 | Fish et al. | 70/189 |
| 5,598,726 | A * | 2/1997 | Cordle | 70/224 |
| 5,934,117 | A * | 8/1999 | Shen | 70/224 |
| 6,929,290 | B2 * | 8/2005 | Don | 292/169 |
| 7,181,940 | B2 | 2/2007 | Lin | |

* cited by examiner

*Primary Examiner* — Lloyd Gall
(74) *Attorney, Agent, or Firm* — Charles E. Baxley

(57) ABSTRACT

A door lock assembly includes a lock casing device and a door lock device attached to the opposite sides of a door panel, a core device pivotally mounted to the lock casing device and operatable by an actuation device, an adjustable shaft mechanism includes a housing coupled to the core device and having a number of orifices and a channel communicative with a chamber of the housing, a shank slidably engaged in the housing and having a free end for engaging with the door lock device, and a spring-biased detent attached to the shank for engaging with either of the orifices of the housing and for anchoring the shank to the housing at a selected position and for adjustably mounting the shaft to the door panels of different thicknesses.

3 Claims, 5 Drawing Sheets

ADJUSTABLE SHAFT FOR DOOR LOCK ASSEMBLY

BACKGROUND OF THE INVENTION

1. Field of the Invention

The present invention relates to a door lock assembly, and more particularly to a door lock assembly including an adjustable shaft mechanism adjustable to different length for adjustably attaching or mounting or securing the door lock assembly onto the door panels of different thicknesses.

2. Description of the Prior Art

Typical door lock mechanisms or assemblies comprise a lock casing device attached or mounted to one side of the door panel, a lock device attached or mounted to the other side or the opposite side of the door panel and having a dead bolt extended out of the lock device for engaging with a door frame, a locking mechanism attached or mounted to the lock casing device for selectively locking the door panel to the door frame, and an actuation unit also attached or mounted to the lock casing device for selectively actuating or operating the dead bolt to lock or to release the door panel.

For example, U.S. Pat. No. 7,181,940 to Lin discloses one of the typical door lock mechanisms or assemblies and was developed by the present applicant and also comprising a lock device attached or mounted to one side of the door panel and having a dead bolt extended out of the lock device for engaging with a door frame, a lock casing device attached or mounted to the other side or the opposite side of the door panel and having a locking mechanism for selectively locking the door panel to the door frame, and having an actuation unit for selectively actuating or operating the dead bolt to lock or to release the door panel.

The actuation unit and the locking mechanism are required to be coupled to the lock device with a shaft for allowing the dead bolt of the lock device to be actuated or operated by the actuation unit and/or the locking mechanism.

However, the shaft includes a predetermined or fixed length that may not be adjusted to different lengths, such that the shaft of the typical door lock mechanisms or assemblies may not be attached or mounted or secured to the door panels of different thicknesses, and such that the shaft may only be fitted or attached or mounted or secured to the door panel that includes a predetermined or fixed thickness only.

The present invention has arisen to mitigate and/or obviate the afore-described disadvantages of the conventional door lock mechanisms or assemblies.

SUMMARY OF THE INVENTION

The primary objective of the present invention is to provide a door lock assembly including an adjustable shaft mechanism adjustable to different length for adjustably attaching or mounting or securing the door lock assembly onto the door panels of different thicknesses.

In accordance with one aspect of the invention, there is provided a door lock assembly comprising a door panel including a first side and a second side, a lock casing device attached to the first side of the door panel, a door lock device attached to the second side of the door panel and including a dead bolt extendible out of the door lock device for selectively engaging with a door frame, a core device pivotally mounted to the lock casing device, an actuation device attached to the lock casing device and coupled to the core device for actuating the core device to operate the dead bolt, an adjustable shaft mechanism including a housing laterally engaged through the door panel and coupled to the core device and rotated in concert with the core device, the housing including a chamber formed therein and including a number of orifices formed therein and communicative with the chamber of the housing, and including a channel formed therein and communicative with the chamber of the housing, a shank slidably engaged in the chamber of the housing and including a free end portion extendible out of the housing for engaging with the door lock device, and a spring-biased projection device attached to the shank and including a spring-biased detent for selectively engaging with either of the orifices of the housing and for adjustably anchoring the shank to the housing at the selected or predetermined positions and thus for adjustably attaching or mounting or securing the adjustable shaft mechanism and the lock casing device and the door lock device to the door panel.

The shank includes an aperture formed therein for receiving the spring-biased detent of the spring-biased projection device. For example, the shank includes a compartment formed therein and communicative with the aperture of the shank and having an inner diameter greater than that of the aperture of the shank, and the spring-biased projection device includes a casing engaged with the compartment of the shank and extended out of the shank and slidably engaged with the channel of the housing, and the casing includes a space formed therein for receiving the spring-biased detent and a spring member, and the detent and the spring member are received or engaged in the aperture of the shank and partially extended out of the shank for engaging with either of the orifices of the housing.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
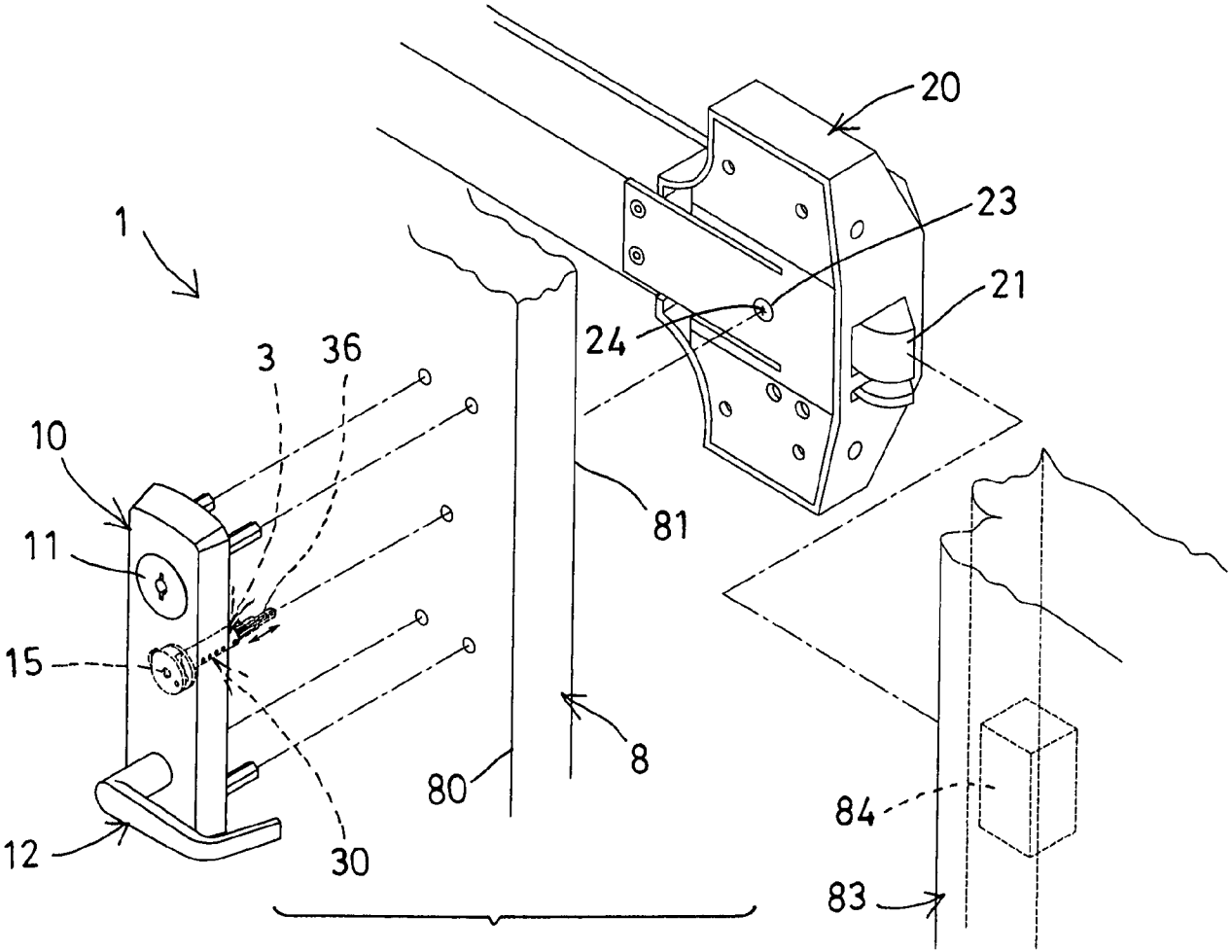
FIG. 1 is a partial exploded view of a door lock assembly in accordance with the present invention.
Figure 3:
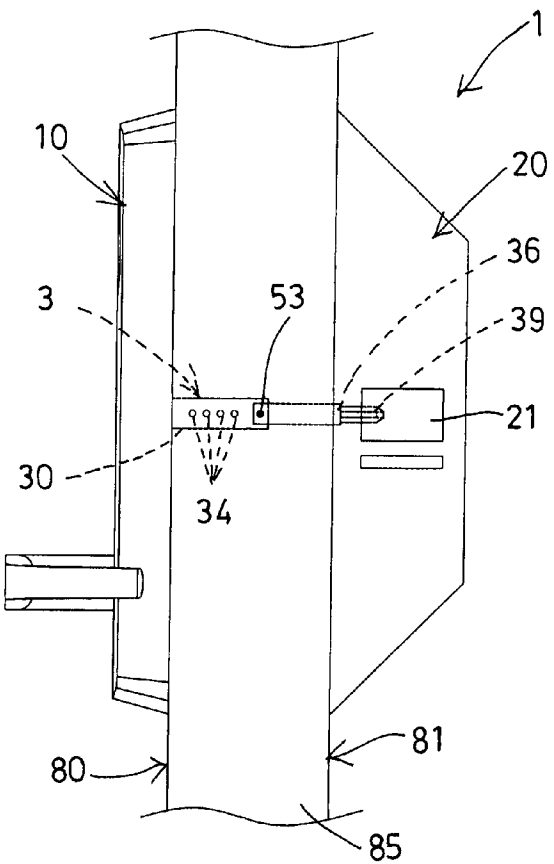
FIG. 3 is a partial plan schematic view similar to FIG. 2 illustrating the attachment of the door lock assembly to a door panel of different thicknesses.
Figure 2:
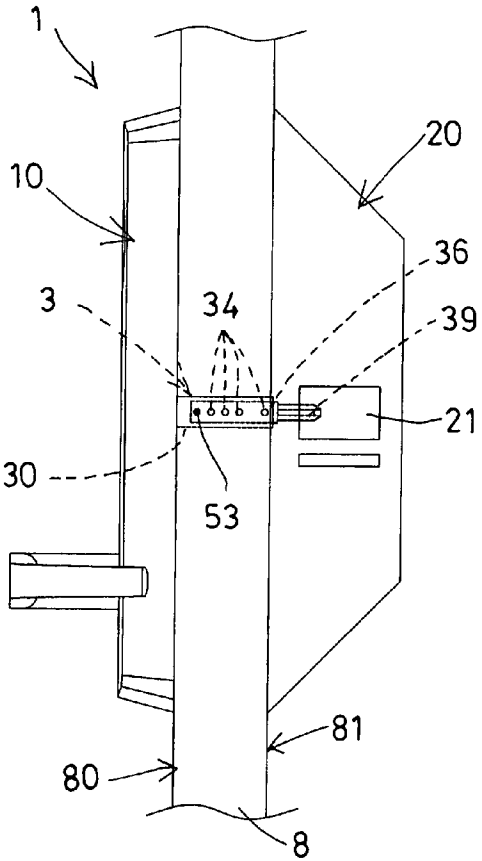
FIG. 2 is a partial plan schematic view illustrating the attachment of the door lock assembly to a door panel.
Figure 4:
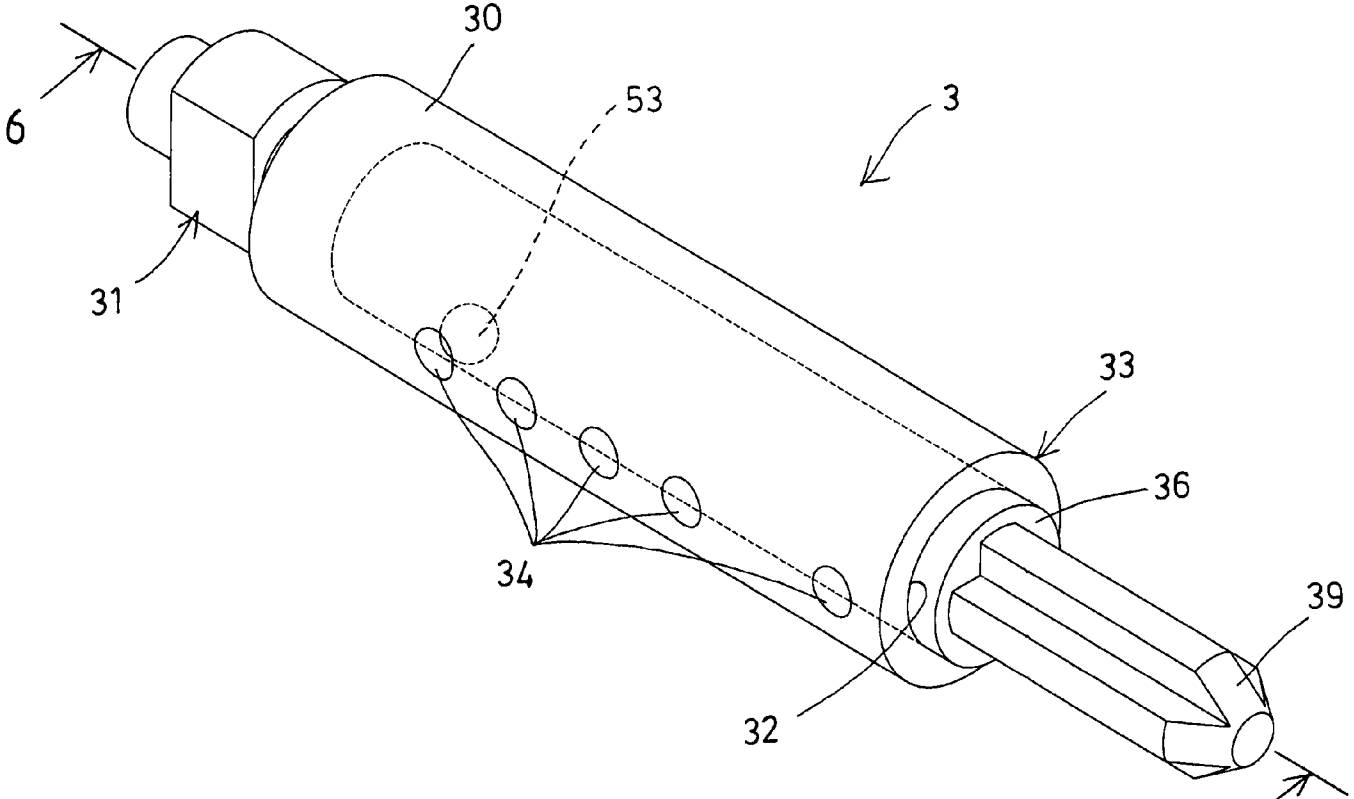
FIG. 4 is a perspective view illustrating an adjustable shaft mechanism for the door lock assembly.
Figure 5:
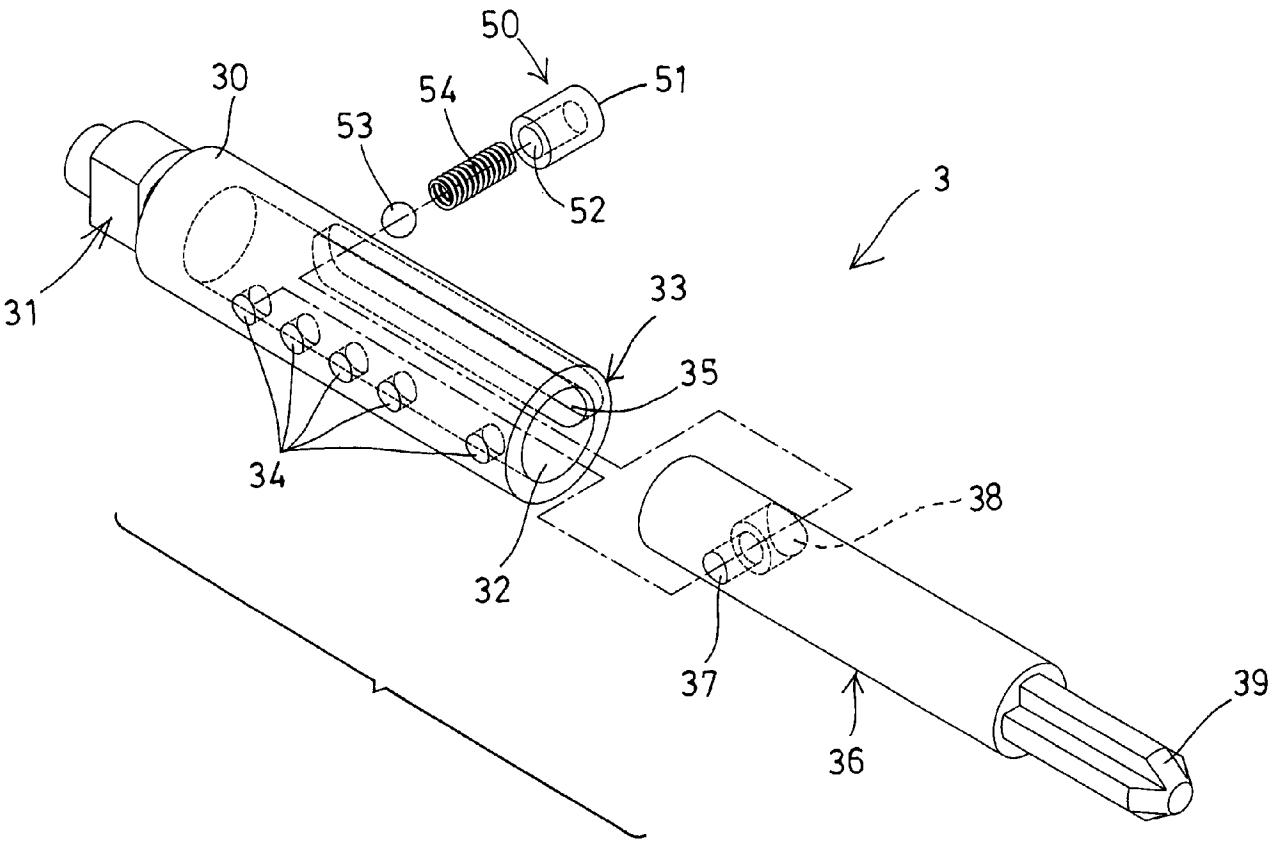
FIG. 5 is a partial exploded view of the adjustable shaft mechanism for the door lock assembly.
Figure 6:
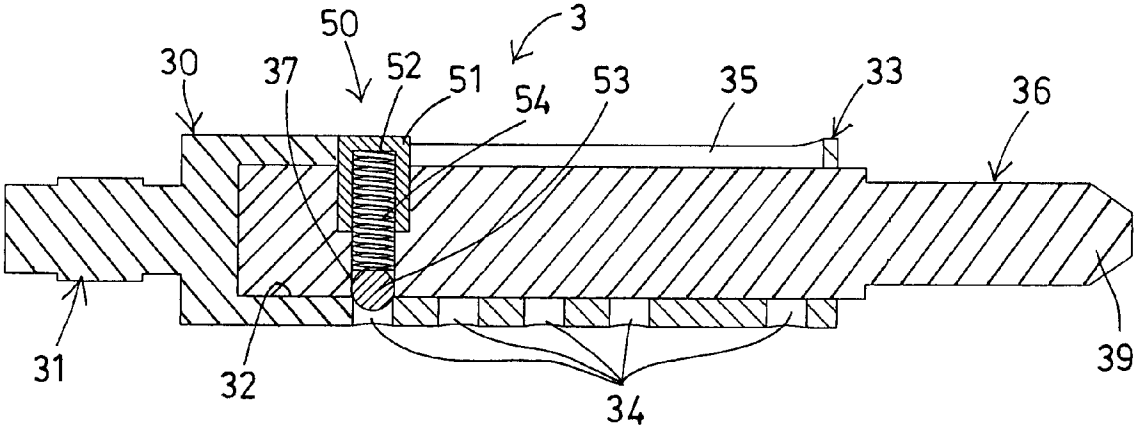
FIG. 6 is a cross sectional view of the adjustable shaft mechanism taken along lines 6-6 of FIG. 4.
Figure 7:
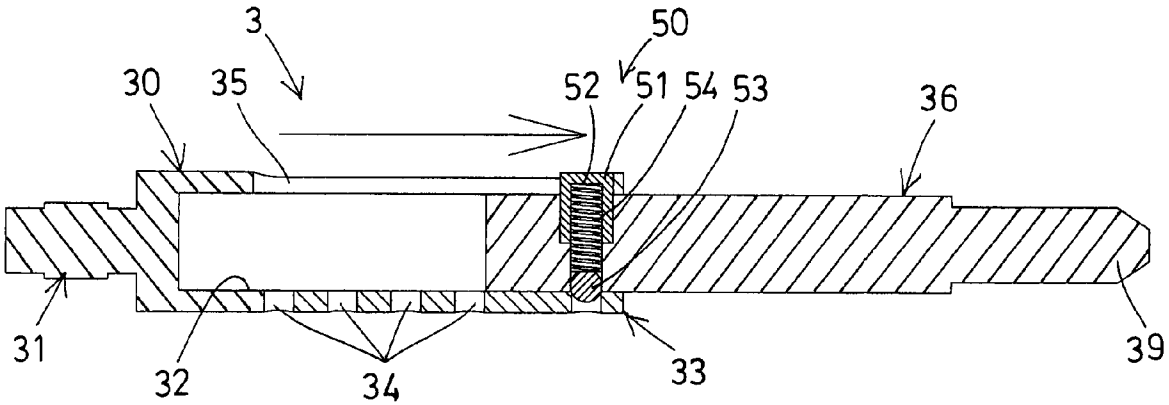
FIG. 7 is a cross sectional view similar to FIG. 6, illustrating the operation of the adjustable shaft mechanism for the door lock assembly.

Referring to the drawings, and initially to FIGS. 1 and 2, a door lock assembly 1 in accordance with the present invention comprises a lock casing device 10 attached or mounted to one side 80 of a door panel 8, a door lock device 20 attached or mounted to the other side or the opposite side 81 of the door panel 8 and having a dead bolt 21 extendible out of the door lock device 20 for engaging with a lock cavity 84 of a door frame 83, a locking mechanism 11 attached or mounted to the lock casing device 10 for selectively actuating the dead bolt 21 to lock the door panel 8 to the door frame 83, and an actuation device 12 also attached or mounted to the lock casing device 10 for selectively actuating or operating the dead bolt 21 to lock or to release the door panel 8.

The lock casing device 10 further includes a core device 15 pivotally or rotatably attached or mounted or coupled to the lock casing device 10, and coupled to the door lock device 20, such as coupled to the dead bolt 21 of the door lock device 20 with an adjustable shaft mechanism 3 in accordance with the present invention, in which the core device 15 is rotatable or actuatable or operatable by the locking mechanism 11 and/or the actuation device 12 in order to selectively rotate or actuate or operate the adjustable shaft mechanism 3 and so as to selectively actuate or operate the dead bolt 21 to engage with the door frame 83, and to lock or to release the door panel 8.

The above-described structure including the lock casing device 10, the locking mechanism 11, the actuation device 12, the core device 15, and the dead bolt 21 of the door lock device 20 is typical and will not be described in further details, and one example of the above-described structure has been disclosed in the present applicant's prior U.S. Pat. No. 7,181,940 to Lin which is taken as a reference for the present invention. The present invention is to provide an adjustable shaft mechanism 3 which is adjustable to different lengths (FIGS. 2-3, 6-7) for adjustably attaching or mounting or securing the door lock assembly 1 onto the door panels 8, 85 of different thicknesses.

As shown in FIGS. 1-6, the adjustable shaft mechanism 3 comprises an outer housing 30 laterally engaged through the door panel 8, 85 (FIGS. 2-3), and including a non-circular end or coupling member 31 for engaging with the core device 15 and for anchoring or coupling the housing 30 to the core device 15 and for allowing the housing 30 and the core device 15 to be rotated in concert with each other. The housing 30 includes a chamber 32, such as a blind chamber 32 formed therein and opened toward or at one end portion 33 of the housing 30, and includes a number of or two or more orifices 34 formed therein, such as formed in the outer peripheral portion thereof and communicative with the chamber 32 of the housing 30, and includes a longitudinal channel 35 formed therein and also communicative with the chamber 32 of the housing 30 and preferably located opposite to the orifices 34 of the housing 30.

The adjustable shaft mechanism 3 further includes a shank 36 slidably engaged within the chamber 32 of the housing 30 and having an outer or free end portion 39 extendible out of the housing 30, and having an aperture 37 laterally formed therein, and having an enlarged compartment 38 formed therein and communicative with the aperture 37 of the shank 36, in which the inner diameter of the compartment 38 of the shank 36 is greater than that of the aperture 37 of the shank 36 for receiving a spring-biased projection device 50. For example, the spring-biased projection device 50 includes a casing 51 engaged within the greater compartment 38 of the shank 36 or attached to the shank 36 and extended out of the shank 36 and slidably engaged with the channel 35 of the housing 30, and the casing 51 includes a space 52 formed therein for receiving a spring-biased ball or detent 53 and a spring member 54, in which the detent 53 and the spring member 54 are also received or engaged within the aperture 37 of the shank 36 and partially extended out of the shank 36 for engaging with either of the orifices 34 of the housing 30.

In operation, as shown in FIGS. 2-3 and 6-7, the shank 36 is slidable or movable or adjustable along or relative to the housing 30 to different positions, and the detent 53 of the spring-biased projection device 50 may be biased and forced by the spring member 54 to engage with either of the orifices 34 of the housing 30 and to anchor or position or secure the shank 36 to the housing 30 at the required or predetermined or selected position or location, for allowing the free end portion 39 of the shank 36 to be engaged with the engaging cavity 24 of a rotary member 23 (FIG. 1) for the dead bolt 21, and thus for allowing the dead bolt 21 of the door lock device 20 to be selectively rotated or actuated or operated by the locking mechanism 11 and/or the actuation device 12, and thus for adjustably attaching or mounting or securing the door lock assembly 1 onto the door panels 8, 85 of different thicknesses.

Accordingly, the door lock assembly in accordance with the present invention includes an adjustable shaft mechanism adjustable to different lengths for selectively and adjustably attaching or mounting or securing the door lock assembly onto the door panels of different thicknesses.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A door lock assembly comprising:

a door panel including a first side and a second side, a lock casing device attached to said first side of said door panel, a door lock device attached to said second side of said door panel and including a dead bolt extendible out of said door lock device for engaging with a door frame, a core device pivotally mounted to said lock casing device, an actuation device attached to said lock casing device for operating said core device, an adjustable shaft mechanism including a housing engaged through said door panel and coupled to said core device and rotated in concert with said core device, said housing including a chamber formed therein and including a plurality of orifices formed therein and communicative with said chamber of said housing, and including a channel formed therein and communicative with said chamber of said housing, a shank slidably engaged in said chamber of said housing and including a free end portion extendible out of said housing for engaging with said door lock device, and a spring-biased projection device attached to the shank and including a spring-biased detent for selectively engaging with either of said orifices of said housing and for anchoring said shank to said housing at a selected position and for adjustably mounting said adjustable shaft mechanism to said door panel.

2. The door lock assembly as claimed in claim 1, wherein said shank includes an aperture formed therein for receiving said spring-biased detent of said spring-biased projection device.

3. The door lock assembly as claimed in claim 2, wherein said shank includes a compartment formed therein and communicative with said aperture of said shank and having an inner diameter greater than that of said aperture of said shank, and said spring-biased projection device includes a casing engaged with said compartment of said shank and extended out of said shank and slidably engaged with said channel of said housing, and said casing includes a space formed therein for receiving said spring-biased detent and a spring member, said detent and said spring member are engaged in said aperture of said shank and partially extended out of said shank for engaging with either of said orifices of said housing.

* * * * *